US006652244B2

(12) United States Patent
Ihring et al.

(10) Patent No.: US 6,652,244 B2
(45) Date of Patent: Nov. 25, 2003

(54) RADIAL PISTON MACHINE

(75) Inventors: Anton Ihring, Göggingen (DE); Michael Reichenmiller, Waldstetten (DE)

(73) Assignee: ZF Lenksysteme GmbH, Schwaebisch Gmuend (DE)

( * ) Notice: Subject to any disclaimer, the term of this patent is extended or adjusted under 35 U.S.C. 154(b) by 62 days.

(21) Appl. No.: 10/068,654

(22) Filed: Feb. 8, 2002

(65) Prior Publication Data

US 2002/0119052 A1 Aug. 29, 2002

(30) Foreign Application Priority Data

Feb. 9, 2001 (DE) ..... 101 06 069

(51) Int. Cl.[7] ..... F04B 1/04
(52) U.S. Cl. ..... 417/273; 92/72
(58) Field of Search ..... 417/273; 92/72; 91/491

(56) References Cited

U.S. PATENT DOCUMENTS 5,716,198 A * 2/1998 Hiltemann et al. ..... 417/273
6,416,298 B1 * 7/2002 Reichenmiller ..... 417/273
6,537,040 B2 * 3/2003 Herrmann et al. ..... 417/273

FOREIGN PATENT DOCUMENTS

DE 43 36 673 5/1995

* cited by examiner

*Primary Examiner*—Charles G. Freay
(74) *Attorney, Agent, or Firm*—Kenyon & Kenyon

(57) ABSTRACT

A radial piston machine, e.g., a radial piston pump, in which an eccentric, rotatable on a stationary axle, drives multiple radially arranged pistons via an external sliding ring. Since a pump of this type operates with intake regulation, the delivery chambers are only partially filled above a middle speed range. Therefore, pressure surges, which cause noises, arise upon the impact of the piston on the oil volumes to be pushed out. These pressure surges may be reduced if a flexible circlip is positioned between the external sliding ring and the eccentric. Such a circlip allows the piston to deflect slightly together with the external sliding ring at the beginning of the pressure stroke, so that pressure peaks are suppressed and the noises are reduced. The flexibility of the circlip is increased using openings, which are positioned along the central axis, i.e., in the plane of the piston axle.

21 Claims, 3 Drawing Sheets

9
26
2
5
18
1
6
3
4
7
8
17
10
14
15
19
12
11
16

29
16a
26
18
29
23
23
29
29
23

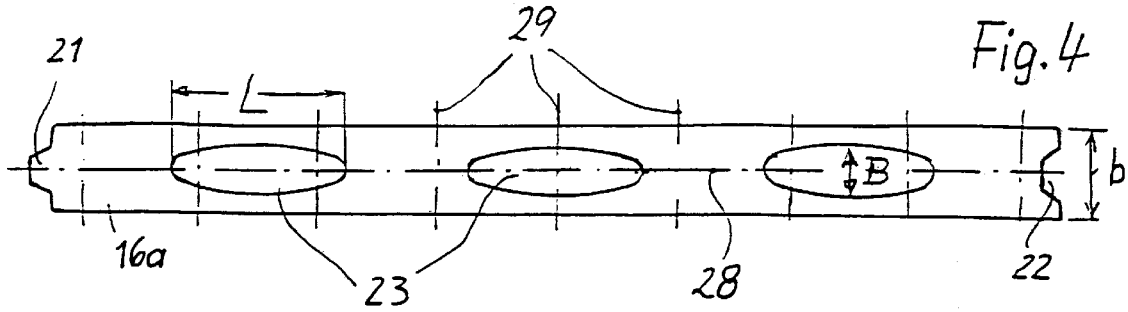
Fig. 4
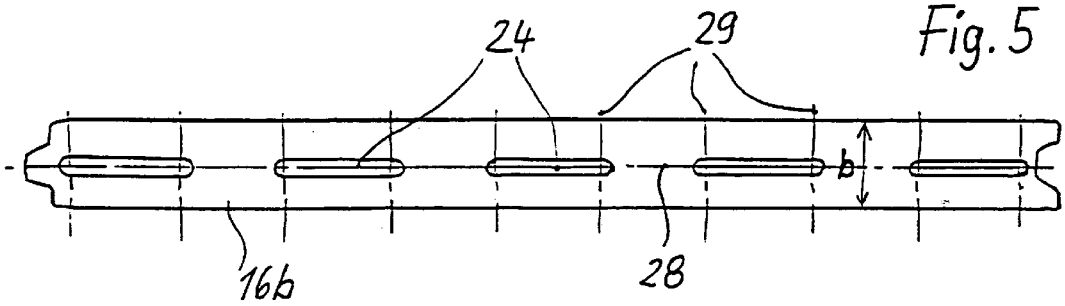
Fig. 5
Fig. 6
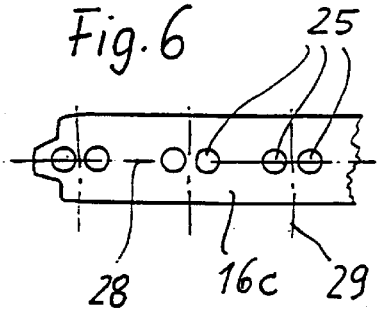
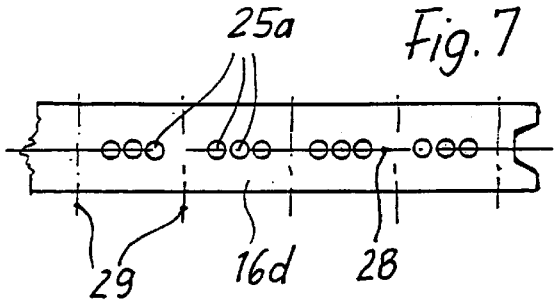
Fig. 7
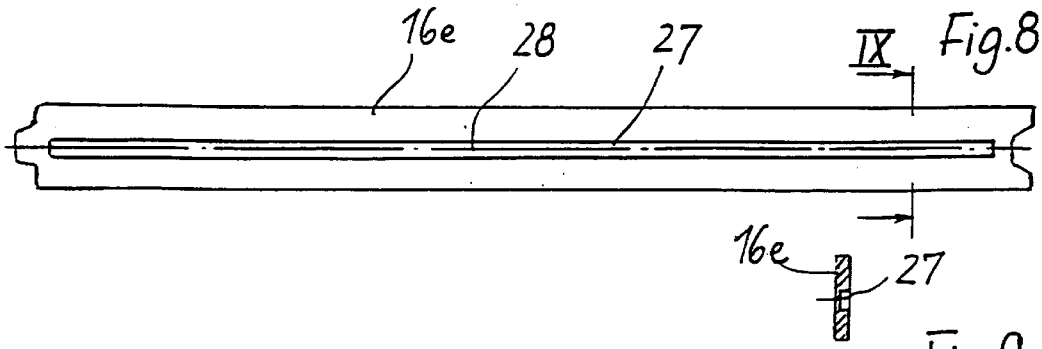
Fig. 8
Fig. 9

RADIAL PISTON MACHINE

FIELD OF THE INVENTION

The present invention relates to a radial piston machine, e.g., a radial piston pump or a radial piston engine.

BACKGROUND INFORMATION

The starting point of the present invention is a machine having a cylinder housing which has multiple radially positioned cylinder bores. A radially displaceable piston, which is centrally supported on an eccentric rotatable relative to the cylinder housing, is located in each cylinder bore. The cylinder housing may be stationary and the eccentric is rotatable. However, the reverse construction is also possible. In most cases, this is therefore a radial piston pump having a stationary cylinder housing and having a rotatable eccentric which is coupled to a component which rotates in operation to drive the pump.

A radial piston pump has the advantage, contingent on its operating principle, that the delivery flow is limited by the intake stroke restriction to an average rotational speed of, for example, 1600 rpm. Above this speed, the piston interior is no longer fully filled. This means that the beginning of delivery is dependent on the filling after the piston has closed its associated suction hole. Upon the beginning of delivery, the piston strikes the enclosed oil column with a velocity dependent on the rotational speed, and pumps the oil out into a collecting channel connected with the user via a non-return valve, implemented as a peripheral leaf spring, which closes all outlet bores of the piston. Since the piston does not begin delivery at zero velocity, a strong pressure surge arises in the piston interior. The pressure peak generated by such a pressure surge exceeds several times the outlet pressure in the collecting channel. Contingent on this principle, the pressure surges are amplified with increasing rotational speed. The pressure surges of all the pistons induce a structure-borne sound which is emitted via the housing wall as airborne sound.

As described in German Published Patent Application No. 43 36 673, an attempt has been made to reduce the pressure peaks caused by the described pressure surges and thus to make the radial piston machine less noisy. In this case, a radially acting attenuator (implemented as a "circlip" or "waved spring," e.g., a polygonal circlip) is provided. This circlip is inserted between two sliding rings which are located between the foot of the piston and the eccentric. This attempted solution does lead to a significant noise reduction. However, there is the disadvantage that the external sliding ring is sometimes highly stressed by bending. Due to this, its service life is insufficient.

It is therefore an object of the present invention to provide a radial piston machine (e.g., a radial piston pump) in which two requirements are met simultaneously, namely the best possible noise reduction during operation of the machine and the least possible stress on the individual components, so that a long service life and/or longer operation without malfunctions may be ensured.

SUMMARY

The above and other beneficial objects of the present invention are achieved by providing a radial piston machine as described herein. According to one example embodiment of the present invention, the stiffness of the circlip is reduced by providing a material weakening along its middle axis.

The concept of "middle axis" does not mean axis of rotation of the eccentric but the center line extending halfway along the width of the circlip around the circumference. This line is in the plane of the piston axis.

The effect of the measure previously described is that the elastic flexibility of those parts of the circlip which reinforce the external sliding ring is increased. When a strong pressure surge arises in one of the piston interiors, the external sliding ring is deformed as before to decrease the pressure surge. However, according to the present invention, the circlip is also deformed to a greater extent than before. The external sliding ring and the circlip are more uniformly stressed by bending than previously, so that overloading of the external sliding ring is avoided without the danger of overloading the circlip. The desired reduction of noise generation is achieved simultaneously, and at least to the same extent as before.

Theoretically, it is possible to increase the elastic flexibility of the circlip by reducing its thickness. However, this is difficult because commercial raw material is not available in the necessary fine thicknesses. A reduction of the thickness by mechanical processing is also not satisfactory due to higher costs. Thus, the provision of a material weakening along the area of the central axis of the circlip according to the present invention—while maintaining a commercial material thickness—is a particularly cost-effective method to achieve increase of the flexibility.

There are numerous possibilities for obtaining the respective optimum degree of flexibility of the circlip by selection of the shape and size of the material weakening—as well as by its positioning along the central axis of the circlip. However, experiments are necessary for optimization.

The present invention is applicable for numerous configurations of radial piston machines, e.g., for radial piston pumps having a stationary cylinder housing and a rotatable eccentric. The circlip may include an open ring, the ring ends of which form a gap. Because of this, the circlip has increased flexibility. It may "breathe." However, the use of a circlip which is closed is also possible. A requirement for the use of an open circlip is, however, that its thickness be sufficiently great so that overlapping of the ring ends is reliably avoided under stress. This is a further aspect which argues against the reduction of the thickness of the circlip as described above.

The width of the circlip from the conventional configuration may be maintained. Thus, it may be ensured that the circlip is securely guided between other components, in the direction of the rotational axis of the eccentric, e.g., between two axial disks. In addition, it is ensured that deformations of the annular spring occurring in operation occur symmetrically to the plane of the piston axis, exactly as is the case of the external sliding ring (and possibly, if present, in the internal sliding ring).

In a further example embodiment of the present invention, an inner sliding ring may be provided between the eccentric and circlip, as described in German Published Patent Application No. 43 36 673. In this manner, during operation the speed of rotation of the internal circlip is at most slightly less than the speed of rotation of the eccentric. Speeds of rotation which are reduced even further will result for the circlip and for the external sliding ring. As a result, the sliding speed of the external sliding ring on the foot of the piston is therefore relatively low. The sliding speed of the internal sliding ring on the eccentric is also rather low. In this manner, very low wear is produced both at the foot of the piston and on the outer face of the eccentric.

The eccentric is, generally, a massive component. Nonetheless if it is necessary to reduce even further the noise arising during operation of the radial piston machine, a flexible eccentric may be provided.

The present invention is described in more detail in the following description with reference to example embodiments which are illustrated in the Figures.

BRIEF DESCRIPTION OF THE DRAWINGS

FIGS. 4 to 8 illustrate various constructions of the circlip illustrated in the developed form.

FIG. 9 is a cross-sectional view taken along the line IX—IX illustrated in FIG. 8.

DETAILED DESCRIPTION

Figure 1:
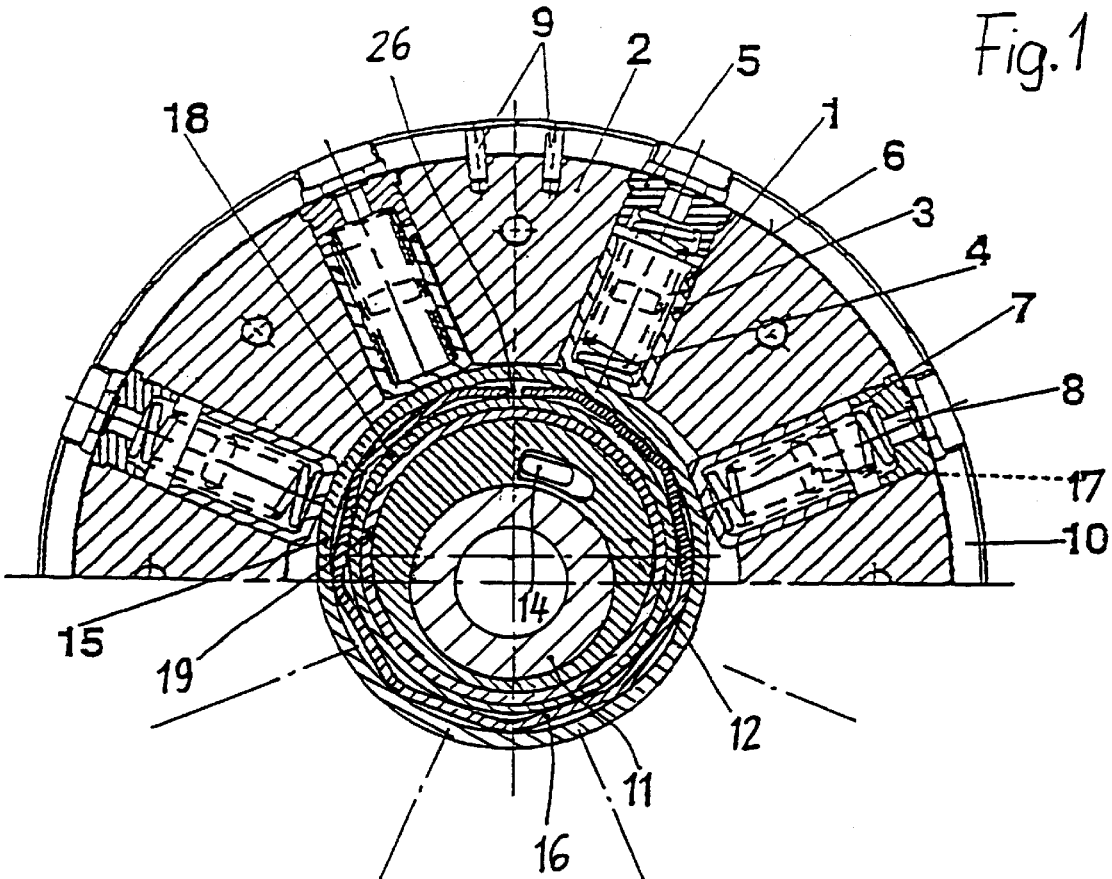
FIG. 1 is a partial cross-sectional view through a radial piston pump having a polygonal circlip, the section taken along the plane of the piston axis, i.e., along the line I—I illustrated in FIG. 3.
Figure 3:
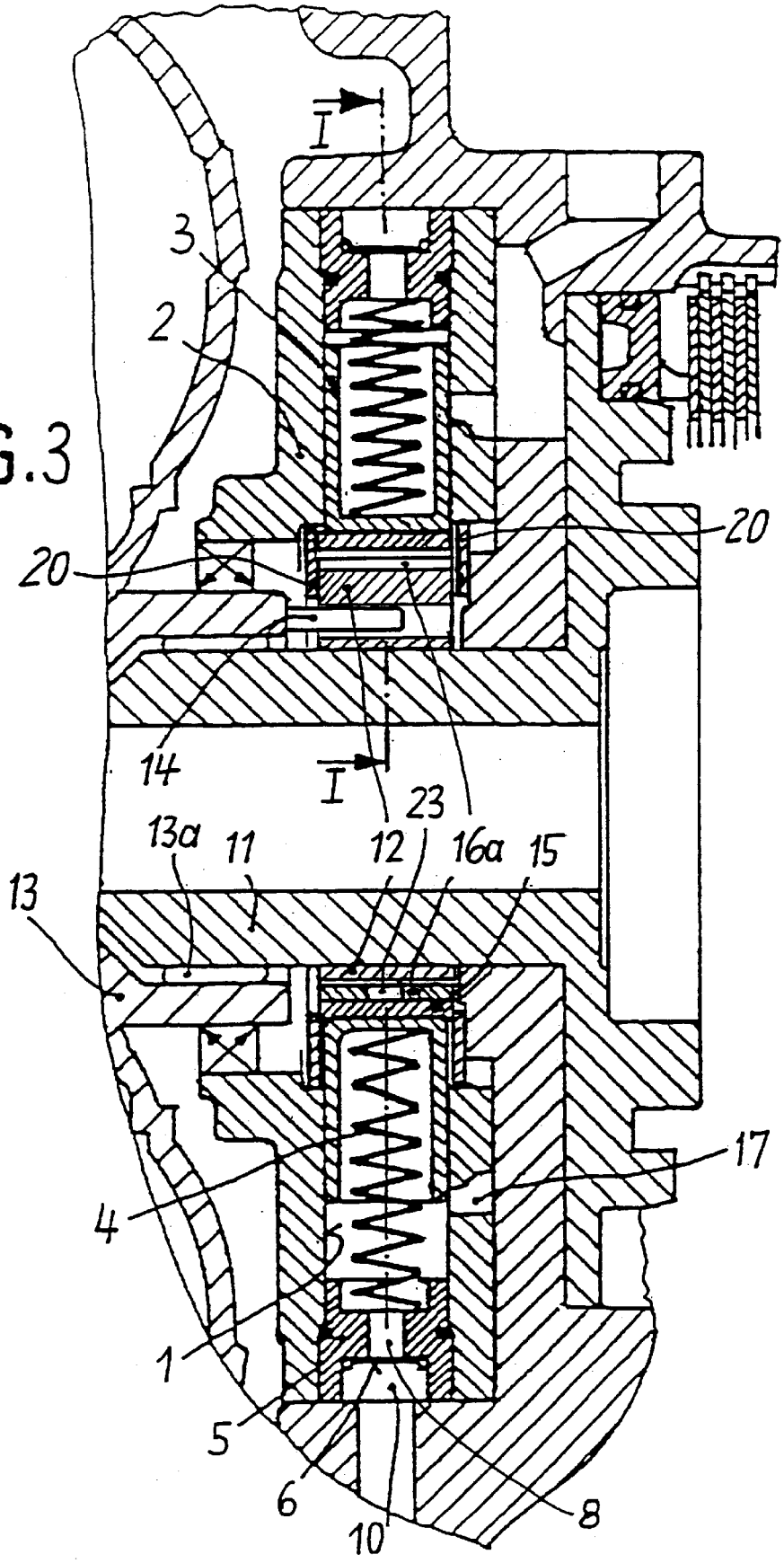
FIG. 3 is a longitudinal cross-sectional view through the radial piston pump illustrated in FIG. 1.

The radial piston pump illustrated in FIGS. 1 and 3 is, for example, integrated in an automatic transmission and has multiple pistons 3 in cylinder bores 1 of a cylinder housing 2 (also called "pump housing"). Each piston 3 is loaded by a spring 4 which supports itself on one of the stoppers 5 which seal cylinder bore 1. A leaf spring 6 surrounds all stoppers 5 in a ring shape and seals all outlet bores 8 adjoining interiors 7 in relation to a collection ring groove 10. Leaf spring 6 is secured in its position on pump housing 2 with pins 9.

A concentric stationary axle 11 (also called "idler wheel hollow shaft") is connected rigidly with pump housing 2. An eccentric 12 is rotatably mounted on this axle. A driving pin 14 of a hollow shaft 13, which operates in rotation, (mounted on axle 11 using needle bearing 13*a*) extends into this eccentric. As illustrated in FIG. 1, an external sliding ring 15, a circlip 16, and an internal sliding ring 18 with a slide bushing 19 are provided between piston 3 and eccentric 12. Elements 18 and 19 are not illustrated in FIG. 3. Axial disks 20 are used for axially guiding elements 12, 15, 16, and possibly 18 and 19.

During rotation of eccentric 12, the respective piston 3 which is pushing out the pressure oil may slightly deflect on the associated section of sliding ring 15 and circlip 16, so that the pressure peaks occurring at the beginning of a pressure stroke and thus the noise generation may be reduced. Pistons 3 aspirate the oil at their upper edges via suction holes 17. In order to discharge the pressurized oil through collecting ring groove 10, leaf springs 6 arch from their seats over the respective piston which is currently performing a pressure stroke.

According to the present invention, the elastic flexibility of circlip 16 is increased by the material weakening provided along its center line 28 (FIGS. 4 to 8), which is in the plane of the piston axle I—I (FIG. 3). This may occur in many different manners, e.g., using through holes or openings or using a longitudinal notch. In a further example embodiment, the openings are positioned in pairs on both sides of center line 28. In any case, it is desirable for width b (FIG. 4) to be kept unchanged with respect to the distance between two axial disks 20 (FIG. 3).

In circlip 16*a* (FIGS. 2 to 4), for example, three continuous openings 23 are provided uniformly distributed around the circumference. Each of these openings 23 has the shape of a narrow ellipse which extends along center line 28. The favorable dimensions (length L, width B, and the number of openings 23) may be determined experimentally.

Figure 2:
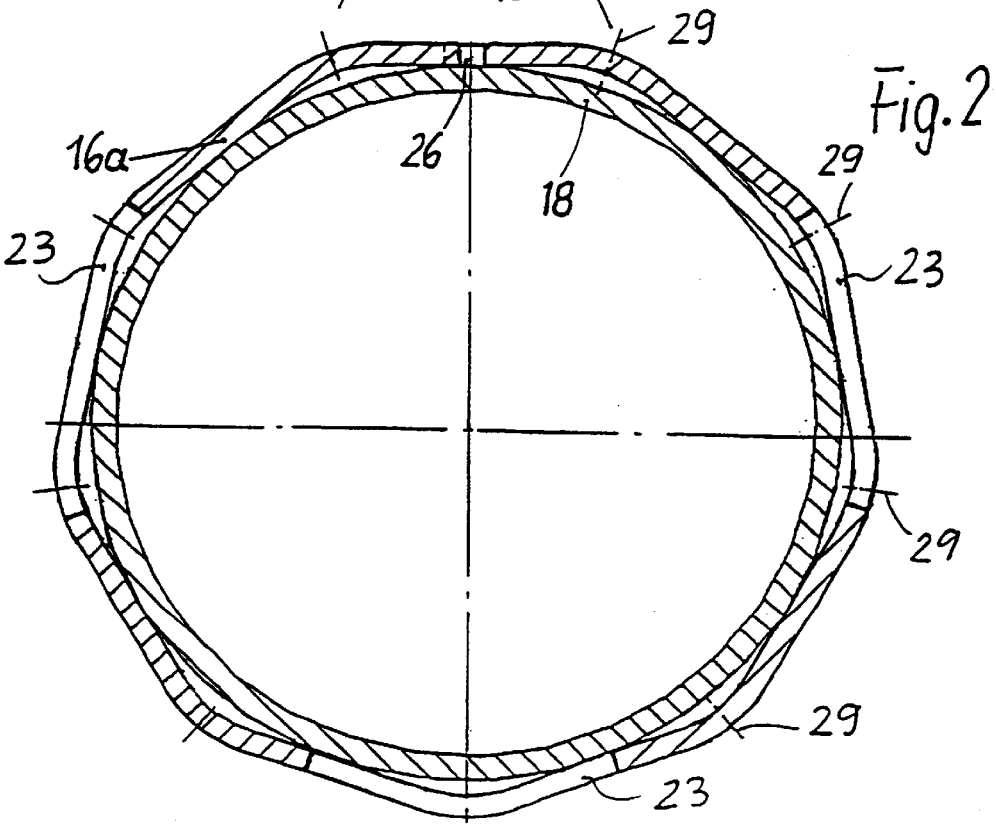
FIG. 2 is a cross-sectional view through the circlip and through an inner sliding ring enlarged relative to FIG. 1.

FIG. 4 illustrates circlip 16*a* in the developed form, i.e., in the state of its manufacture in which it still exists as a flat piece of spring steel strip. Openings 23 may be produced by stamping. A tooth 21 is provided at one end of circlip 16*a* which engages in a slot 22 of the other end after deformation into the ring shape. Nine dot-dash lines 29 indicate the positions at which nine rounded corners are produced during reforming. Essentially straight sections remain between corners 29 as illustrated in FIG. 2. The number of corners "nine" results from the number of cylinders "eight." Typically, the number of corners of the annular spring deviates from the number of cylinders by an odd number, e.g., by the number one. In this manner, resonance between the piston movements and the pulsing deformation of the annular spring is avoided.

FIG. 5 illustrates another example embodiment in which circlip 16*b* has five relatively narrow longitudinal bores 24, centrally positioned. Each longitudinal bore 24 extends approximately from one corner 29 up to the next corner.

As illustrated in FIGS. 6 and 7, round holes 25 and/or 25*a*, which are stamped or bored, are provided as a material weakening. The number, size, and arrangement of the holes may be determined on the basis of experiments. Annular spring 16*c* illustrated in FIG. 6 has, for example, a group of two holes 25 in the region of each corner 29. Circlip 16*d* illustrated in FIG. 7 has a group of, for example, three holes 25*a* in each approximately straight zone located between two corners 29.

In circlip 16*e* illustrated in FIGS. 8 and 9, a central longitudinal notch 27 is provided as a material weakening. This extends over almost the entire length of developed circlip 16*e*. In the case of a closed (endless) circlip, a longitudinal notch of this type may extend around the entire circumference of the annular spring.

What is claimed is:

1. A radial piston machine, comprising:

a cylinder housing including a plurality of radially positioned cylinder bores;

a radially relocatable piston, centrally supported on an eccentric, located in each cylinder bore;

an external sliding ring, the pistons in contact with the external sliding ring; and a circlip configured as a radial shock absorber located between the external sliding ring and the eccentric, the circlip including a material weakening along a region of a central axis.

2. The radial piston machine according to claim 1, wherein the radial piston machine is configured as a radial piston pump.

3. The radial piston machine according to claim 1, wherein the cylinder housing is stationary and the eccentric is coupled to a component configured to rotate in operation.

4. The radial piston machine according to claim 1, wherein the circlip includes an open ring having ring ends that form a gap.

5. The radial piston machine according to claim 1, wherein the circlip includes a polygonal shape.

6. The radial piston machine according to claim 5, wherein the circlip includes substantially linear sections that transition into one another by rounded corners.

7. The radial piston machine according to claim 6, wherein a number of the corners of the circlip deviates by an odd number from a number of the pistons.

8. The radial piston machine according to claim 7, wherein the number of the corners of the circlip deviates by one from the number of the pistons.

9. The radial piston machine according claim 1, wherein a width of the circlip is at least approximately equal to a width of the eccentric and of the external sliding ring and is slightly greater than a diameter of the cylinder bore.

10. The radial piston machine according claim 1, wherein the material weakening provided in the circlip is in the form of continuous openings positioned one after another around a circumference of the circlip.

11. The radial piston machine according to claim 10, wherein the continuous openings include at least one of a hole and a slot.

12. The radial piston machine according to claim 10, wherein at least one of the openings and groups of the openings are distributed uniformly around the circumference of the circlip.

13. The radial piston machine according to claim 10, wherein one of the openings and groups of the openings are positioned in straight sections of the circlip.

14. The radial piston machine according to claim 10, wherein the circlip includes corners and wherein one of the openings and groups of the openings are positioned in a region of the corners of the circlip.

15. The radial piston machine according to claim 10, wherein the circlip includes corners and wherein one of one single opening and a group of openings extends from a region of one corner of the circlip to one of a region of a next corner of the circlip and a corner of the circlip after that.

16. The radial piston machine according to claim 10, wherein at least a part of the openings includes one of an oval shape and an elliptical shape.

17. The radial piston machine according to claim 1, wherein the circlip is produced by shaping a metal sheet strip.

18. The radial piston machine according to claim 17, wherein the openings provided in the circlip are configured to be produced by stamping.

19. The radial piston machine according to claim 1, wherein the material weakening provided in the circlip is in the form of a longitudinal notch that extends along the central axis around a circumference.

20. The radial piston machine according to claim 1, further comprising an inner sliding ring arranged between the circlip and the eccentric.

21. The radial piston machine according to claim 1, wherein the cylinder housing includes a pump housing.

* * * * *